US012768091B2

(12) United States Patent
Lee et al.

(10) Patent No.: US 12,768,091 B2
(45) Date of Patent: Oct. 20, 2026

(54) FOOTWEAR CLEANING BASKET FOR A WASHING MACHINE APPLIANCE

(71) Applicant: Haier US Appliance Solutions, Inc., Wilmington, DE (US)

(72) Inventors: Julia Lee, Fullerton, CA (US); Brittany Willis, Cincinnati, OH (US); Yifan Wang, Beaverton, OR (US); Nina Kanonye, Lafayette, LA (US); Shubha Vijayaraj, Fort Wayne, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 112 days.

(21) Appl. No.: 18/755,123

(22) Filed: Jun. 26, 2024

(65) Prior Publication Data

US 2026/0002308 A1 Jan. 1, 2026

(51) Int. Cl.

| | |
|---|---|
| ***A46B 5/00*** | (2006.01) |
| ***A46B 13/00*** | (2006.01) |
| ***A46B 13/02*** | (2006.01) |
| ***D06F 23/04*** | (2006.01) |
| ***D06F 37/14*** | (2006.01) |

(52) U.S. Cl.

CPC ..... *D06F 37/14* (2013.01); *A46B 5/0012* (2013.01); *A46B 13/001* (2013.01); *A46B 13/02* (2013.01); *D06F 23/04* (2013.01); *A46B 2200/306* (2013.01)

(58) Field of Classification Search

None

See application file for complete search history.

(56) References Cited

U.S. PATENT DOCUMENTS 7,401,479 B2 7/2008 Fields

FOREIGN PATENT DOCUMENTS

| | | | | |
|---|---|---|---|---|
| CN | 87209346 U | | 2/1988 | |
| CN | 111607934 A | | 9/2020 | |
| CN | 112111913 A | * | 12/2020 | ..... D06F 23/04 |
| CN | 213721835 U | | 7/2021 | |
| CN | 217244270 U | | 8/2022 | |
| CN | 115177195 A | | 10/2022 | |
| CN | 219048337 U | | 5/2023 | |
| CN | 219250093 U | | 6/2023 | |
| IN | 202111056997 A | | 6/2023 | |
| KR | 20040009742 A | | 1/2004 | |
| KR | 20070025486 A | | 3/2007 | |

* cited by examiner

*Primary Examiner* — Levon J Shahinian

(74) *Attorney, Agent, or Firm* — Dority & Manning, P.A.

(57) ABSTRACT

A washing machine appliance may include a wash tub positioned within a cabinet. The washing machine appliance may include a wash basket rotatably mounted within the wash tub and defining a wash chamber configured for receiving a load of clothes. The washing machine appliance may include a footwear cleaning basket positioned within the wash basket. The footwear cleaning basket may include a top wall and an outer wall extending downward from the top wall along the axial direction. The outer wall may include a bottom rim at a bottom thereof. The footwear cleaning basket and the wash basket may define a footwear cleaning space therebetween. The footwear cleaning basket may include a cleaning brush attached to the bottom rim of the footwear cleaning basket. The cleaning brush may extend downward from the bottom rim along the axial direction into the footwear cleaning space.

18 Claims, 6 Drawing Sheets

FOOTWEAR CLEANING BASKET FOR A WASHING MACHINE APPLIANCE

FIELD OF THE DISCLOSURE

The present subject matter relates generally to a washing machine appliance and more particularly to a footwear cleaning basket for a washing machine appliance.

BACKGROUND OF THE DISCLOSURE

Washing machine appliances generally include a cabinet which supports a wash tub for containing wash fluid, e.g., wash water, detergent, bleach, or other wash additives. A wash basket is mounted within the wash tub and defines a wash chamber for receipt of articles for washing. During operation of such washing machine appliances, wash fluid is directed into the wash tub and onto articles within the wash chamber of the wash basket. The wash basket or an agitation element can rotate at various speeds to agitate articles within the wash chamber in the wash fluid. A spin cycle is often included after some cycles, for example at the end of a wash cycle or a rinse cycle. During the spin cycle, the wash basket spins at a high speed to urge wash fluid from articles within the wash chamber.

Often, a user may utilize the washing machine appliance to launder heavy articles (e.g., comforter, towels, footwear, etc.). Laundering of these articles can result in numerous drawbacks to the performance of the washing machine appliance. For example, the placement of the heavy articles within the wash basket can cause an uneven distribution of weight during a spin cycle. This may result in imbalances (e.g., excessive displacement of the wash tub and wash basket) of the washing machine appliance. In some instances, imbalances can result in excessive vibration, noise, or improper cleaning of the heavy articles within the wash basket. Additionally, imbalances can cause damage to the washing machine appliance over time due to repeated unwanted movements of the wash basket that may occur.

Accordingly, a washing machine appliance that obviates one or more of the above-mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a washing machine appliance is provided. The washing machine appliance may include a wash tub positioned within a cabinet. The wash tub may define an axial direction, a radial direction, and a circumferential direction. The washing machine appliance may include a wash basket rotatably mounted within the wash tub and defining a wash chamber configured for receiving a load of clothes. The washing machine appliance may include a footwear cleaning basket positioned within the wash basket. The footwear cleaning basket may include a top wall and an outer wall extending downward from the top wall along the axial direction. The outer wall may include a bottom rim at a bottom thereof. The footwear cleaning basket and the wash basket may define a main cleaning space and a footwear cleaning space therebetween. The main cleaning space being positioned above the footwear cleaning space. The footwear cleaning basket may include a cleaning brush attached to the bottom rim of the footwear cleaning basket. The cleaning brush may extend downward from the bottom rim along the axial direction into the footwear cleaning space.

In another exemplary aspect of the present disclosure, a footwear cleaning basket for a top-load washing machine appliance is provided. The top-load washing machine appliance may include a cabinet, a wash tub positioned within the cabinet, and a wash basket rotatably mounted within the wash tub and defining a wash chamber. The footwear cleaning basket may include a top wall and an outer wall extending downward from the top wall along an axial direction. The outer wall may include a bottom rim at a bottom thereof. The footwear cleaning basket and the wash basket may define a main cleaning space and a footwear cleaning space therebetween. The main cleaning space may be positioned above the footwear cleaning space. The footwear cleaning basket may include a cleaning brush attached to the bottom rim of the basket. The cleaning brush may extend downward from the bottom rim along the axial direction into the footwear cleaning space.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
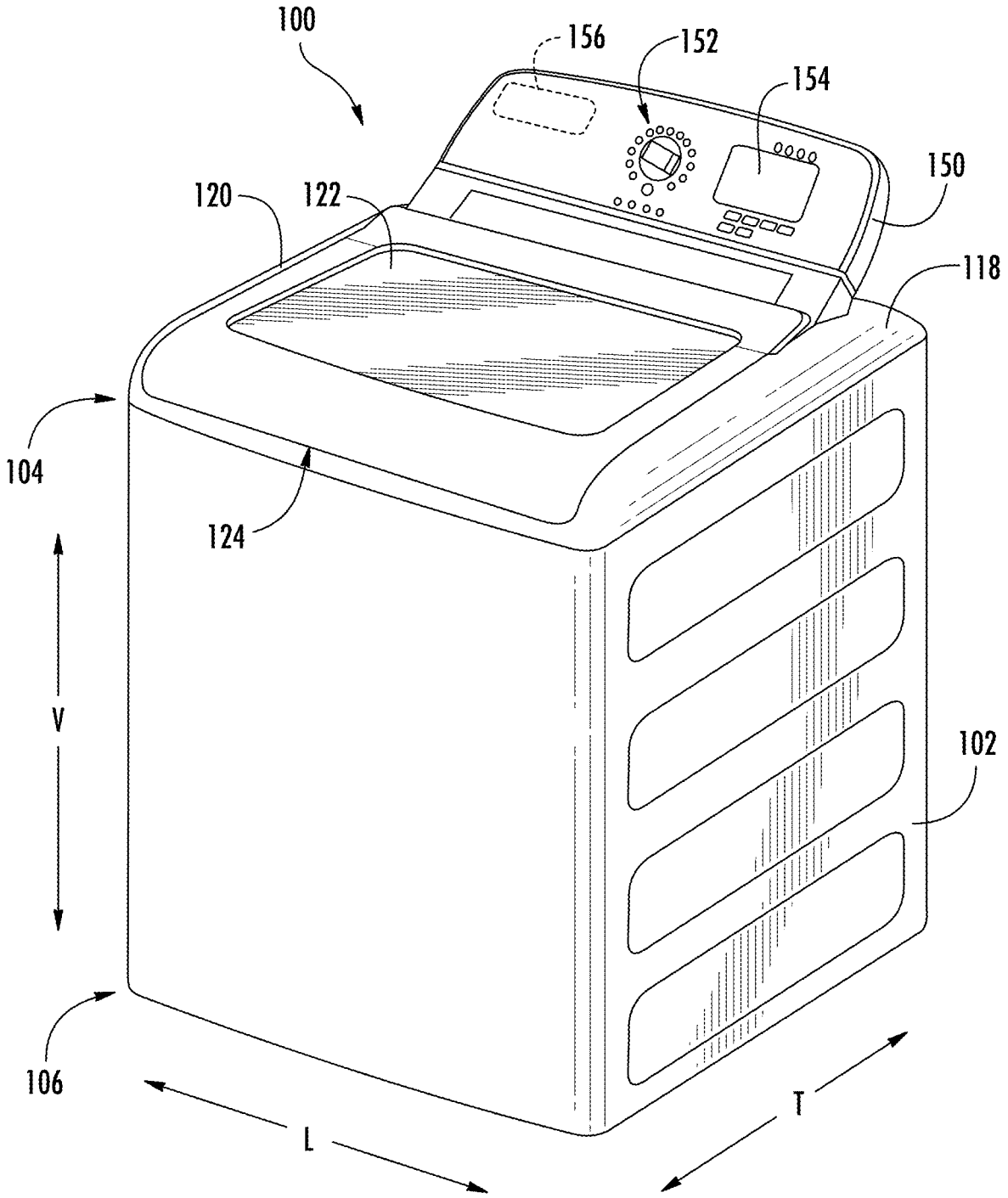
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Generally, a washing machine appliance may be provided in some aspects of the present disclosure. The washing machine appliance can include a cabinet having a wash tub positioned therewithin. A wash basket can be rotatably mounted within the wash tub. The wash basket can define a wash chamber for receiving a load of articles. In some cases, heavy articles such as footwear articles (e.g., shoes, sandals, etc.) may be received within the wash chamber for washing. The laundering of footwear articles within a washing machine appliance can cause numerous problems. For example, the laundering of footwear articles within a washing machine appliance can cause imbalances during operation of the washing machine appliance, such as during a spin cycle of the washing machine appliance. In some cases, a slight imbalance may cause vibration or noise. In some other cases, the wash tub may contact the cabinet of the appliance. These impacts or "cabinet strikes" are noisy and can cause the washing machine to "walk" on the floor. Over time, these impacts can damage the washing machine appliance. In yet some other cases, the imbalance can cause damage to the articles or may not sufficiently clean the articles positioned within the wash basket.

Notably, embodiments of the present subject matter are generally directed to a footwear cleaning basket that can be disposed or positioned within the wash basket of the washing machine appliance when laundering of footwear articles is desired. In several embodiments, the footwear cleaning basket is selectively positioned on or around an agitation element of the washing machine appliance, for instance, within the wash basket. Specifically, the footwear cleaning basket and the wash basket can define a "donut" shaped cleaning space within the wash basket. The cleaning space may advantageously be sized and shaped such that footwear articles securely placed therewithin. Notably, the size and shape of the cleaning space can prevent or mitigate movement of footwear articles within the wash basket during operation of the washing machine appliance. Moreover, this can prevent or mitigate imbalances as the heavy articles can be placed evenly around the wash basket in the cleaning space prior to operation. Due to the size and shape of the cleaning space, the articles may be constrained within the wash basket during a wash cycle.

Moreover, embodiments of the present subject matter advantageously provide one or more cleaning brushes (e.g., one or more physical agitating components) that are attached to the footwear cleaning basket and positioned within the cleaning space. The cleaning brush may more effectively clean the heavy articles positioned within the cleaning space and the cleaning brush may physically agitate or brush the heavy articles during operation.

Figure 2:
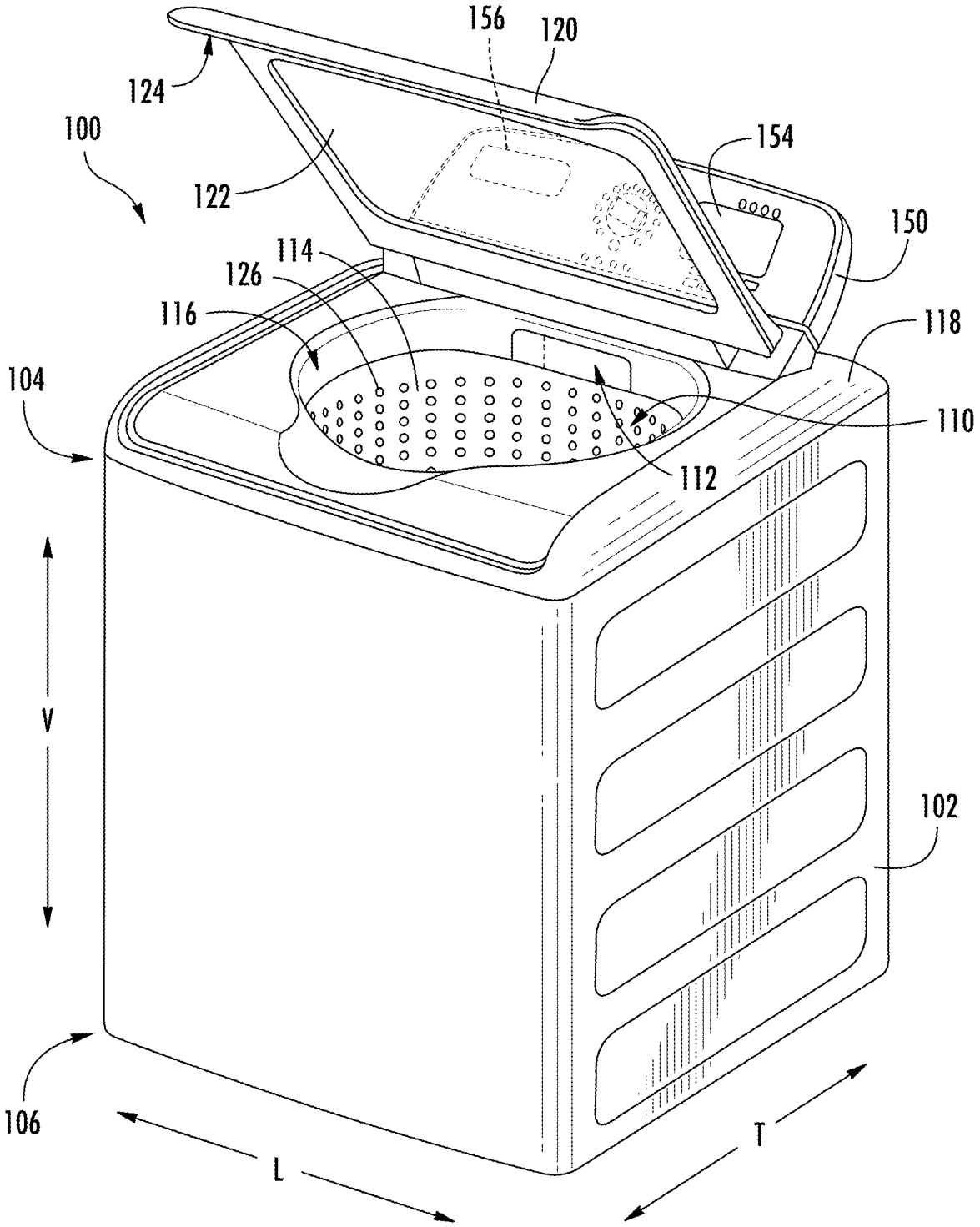
FIG. 2 provides a perspective view of the example washing machine appliance of FIG. 1 with the lid of the washing machine appliance shown in an open position according to one or more exemplary embodiments of the present subject matter.
Figure 3:
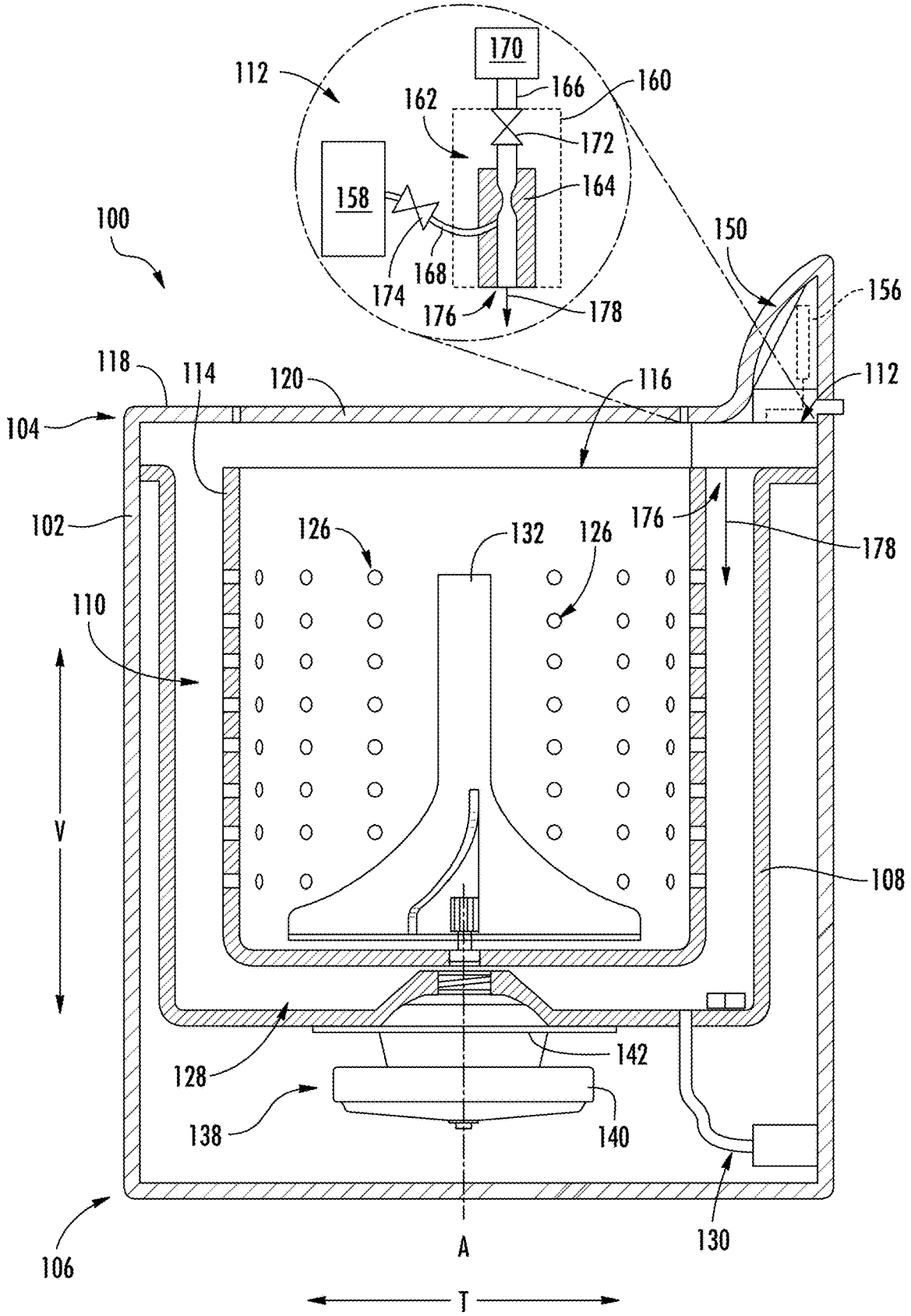
FIG. 3 provides a side cross-sectional view of the example washing machine appliance of FIG. 1 according to one or more exemplary embodiments of the present subject matter.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (e.g., FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (e.g., FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (e.g., as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (e.g., FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (e.g., FIG. 1) extends from top panel 118. Control panel 150 and input selector 152 collectively form a user interface input for operator selection of machine cycles and features. A display 154 of control panel 150 indicates selected features, operation mode, a countdown timer, or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent or other fluid additives via dispensing assembly 112. One or more valves can be controlled by washing machine appliance 100 to provide for filling wash tub 108 and wash basket 114 to the appropriate level for the amount of articles being washed or rinsed. By way of example for a wash mode, once wash basket 114 is properly filled with fluid, the contents of wash basket 114 can be agitated (e.g., with agitation element 132 as discussed previously) for washing of laundry items in wash basket 114.

After completion of the agitation cycle, washing machine appliance 100 may perform one or more rinse cycles. Specifically, according to an example embodiment, drain pump assembly 130 may drain the wash fluid from wash tub 108 and dispensing assembly 112 may dispense fresh water or a wash additive (such as fabric softener) into the wash tub. The load of clothes may then be agitated in the fresh water, e.g., to remove soil and detergent from load of clothes. After completion of the rinse cycle(s), drain pump assembly 130 may drain wash tub 108 and a spin cycle may be used to extract water from the clothes before the wash cycle is concluded.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, or other additives, while the wash fluid for a rinse cycle may be water only or additional rinse additives.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive.

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive. After the target volume of wash additive is dispensed into wash tub 108, additional water may be provided into wash tub 108 as needed to fill to the desired wash volume. It should be appreciated that the target volume may be pre-programmed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additive from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash tub 108. In this regard, discharge nozzle 176 may be positioned above wash tub 108 proximate a rear of opening 116 defined through top panel 118. Dispensing assembly 112 may be regulated by controller 156 to discharge wash fluid 178 through discharge nozzle 176 at the desired flow rates, volumes, or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of wash tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 130 may operate to discharge wash fluid from wash tub 108, e.g., to an external drain. After articles disposed in wash basket 114 are cleaned or washed, the user can remove the articles from wash basket 114, e.g., by reaching into wash basket 114 through opening 116.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, or different features may also be utilized with the present subject matter as well, e.g., horizontal axis washing machine appliances. In addition, aspects of the present subject matter may be utilized in a combination washer/dryer appliance.

Figure 4:
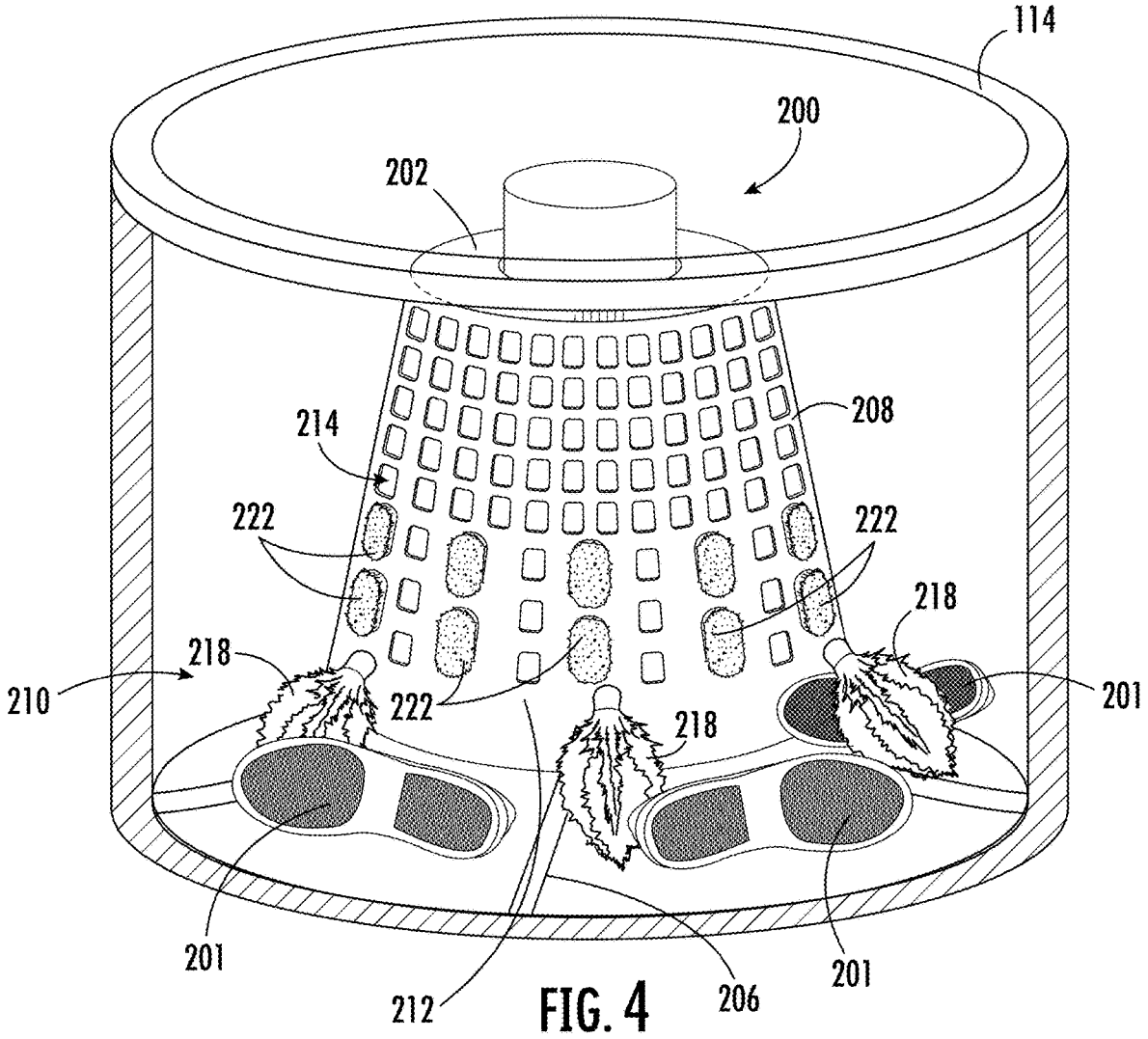
FIG. 4 provides a perspective view of a wash basket of the exemplary washing machine appliance of FIG. 1 with a footwear cleaning basket disposed therewithin according to one or more exemplary embodiments of the present subject matter.
Figure 5:
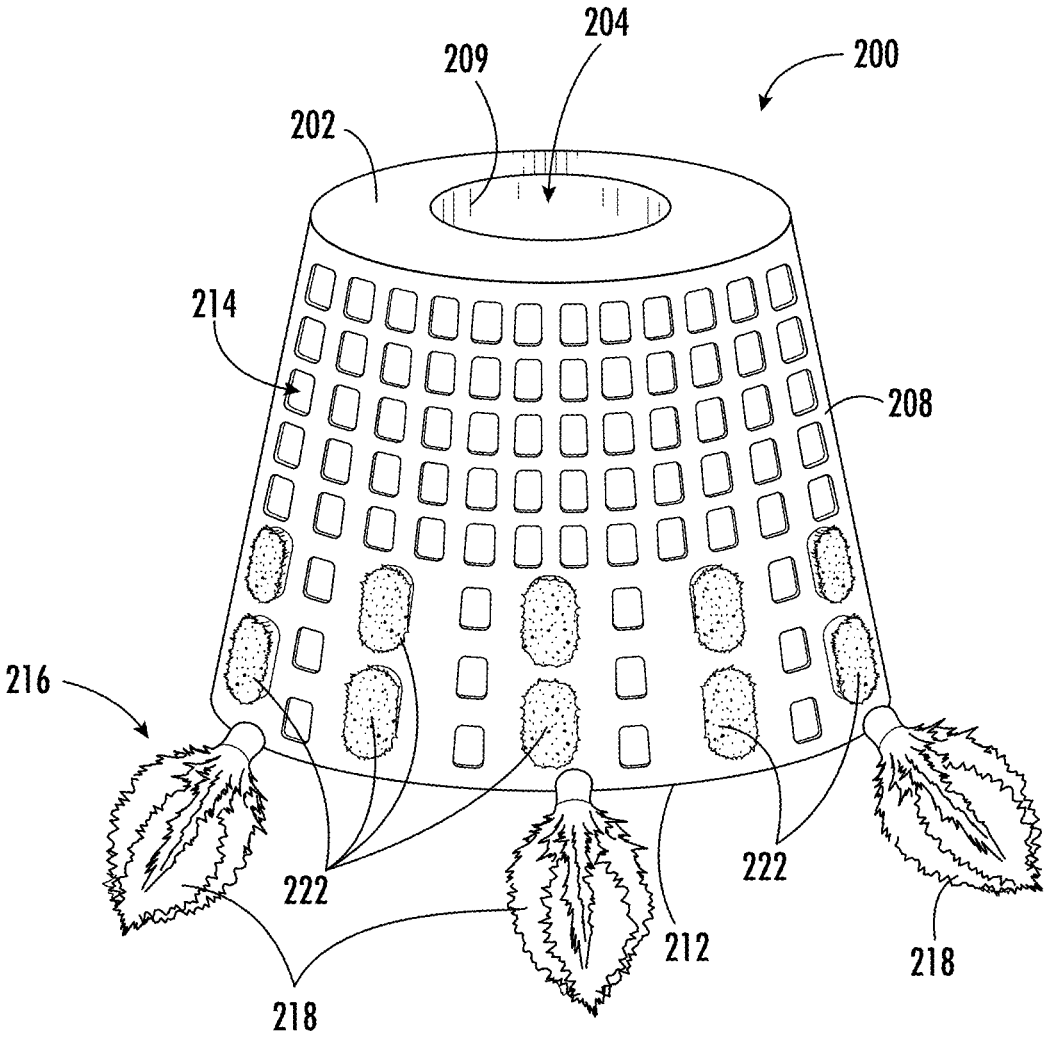
FIG. 5 provides a perspective view of the footwear cleaning basket of FIG. 4 according to one or more exemplary embodiments of the present subject matter.
Figure 6:
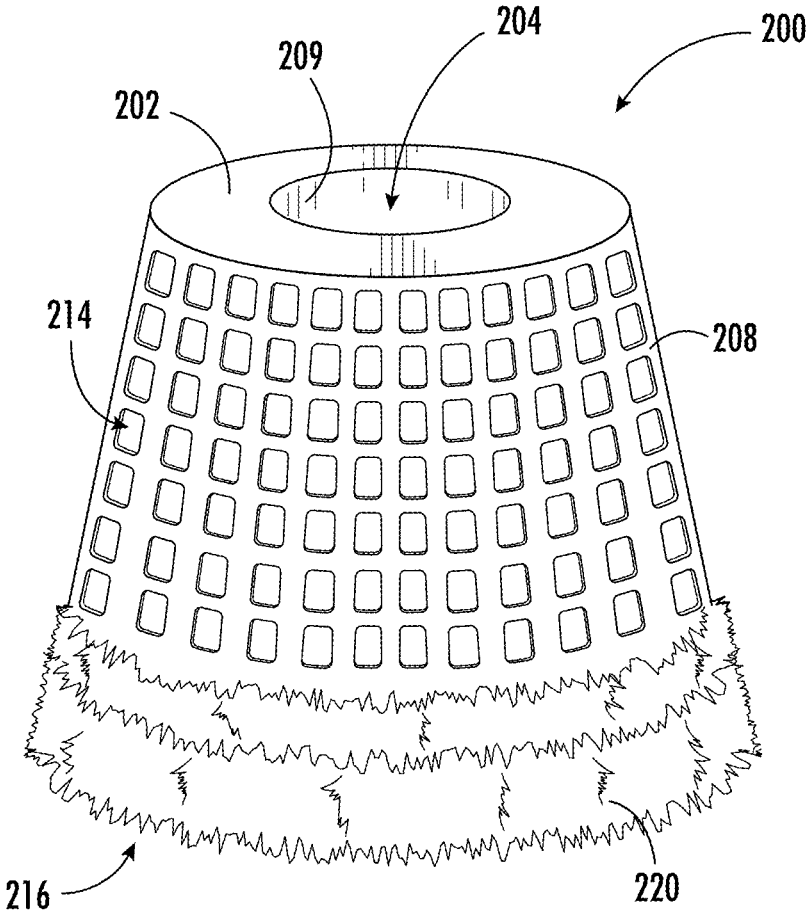
FIG. 6 provides a perspective view of a footwear cleaning basket according to one or more exemplary embodiments of the present subject matter.

Referring now to FIGS. 4 through 6, perspective views of the wash basket 114 and a footwear cleaning basket 200 for cleaning footwear articles 201 (e.g., shoes, sandals, etc.) within the wash basket 114 are provided. The footwear cleaning basket 200 may be selectively positioned within the wash basket 114 when cleaning of footwear articles 201 is desired. For instance, the footwear cleaning basket 200 may be selectively engaged with or disengaged from the agitation element 132 of the washing machine appliance 100. Particularly, the footwear cleaning basket 200 may include a top wall 202 defining an agitation hole 204 for slidably receiving the agitation element 132 therethrough. When received on the agitation element 132, the top wall 202, or footwear cleaning basket 200 generally, may be fixed relative to the agitation element 132 (e.g., to rotate or oscillate therewith). The agitation hole 204 may be complementary in shape to the agitation element 132. For instance, the agitation hole 204 may include a main center hole for receiving the stem of the agitation element 132 and a plurality of slits that extend from the main center hole for receiving fins of the agitation element 132. In this regard, when the footwear cleaning basket 200 is installed within the wash basket 114, the footwear cleaning basket 200 may be positioned around or over the agitation element 132, and more particularly, may be seated on an impeller 206 of the agitation element 132 disposed at the bottom wall of the wash basket 114.

Moreover, when installed within the wash basket 114, the footwear cleaning basket 200 and the wash basket 114 may define one or more cleaning spaces for receiving articles for laundering therebetween. Particularly, an outer wall 208 of the footwear cleaning basket 200 and the wash basket 114 may define a footwear cleaning space 210 (e.g., FIG. 4) therebetween for receiving articles for cleaning. As will be appreciated in more detail below, the footwear cleaning basket 200 may constrain the footwear articles 201 to the footwear cleaning space 210. For example, the wash basket 114 may define a height (e.g., a distance from a bottom surface of the wash basket 114 to a top surface or rim of the wash basket 114 such as along the vertical direction V) and the footwear cleaning space 210 may be positioned at or below a bottom fifty percent of the height of the wash basket 114 (e.g., along the vertical direction V). As another example, the footwear cleaning space 210 may be positioned at or below a bottom thirty five percent of the height of the wash basket 114. As yet another example, the footwear cleaning space 210 may be positioned at or below a bottom twenty percent of the height of the wash basket 114.

In some embodiments, the outer wall 208 of the footwear cleaning basket 200 extends downward (e.g., along or parallel to the vertical direction V such as along the axis of rotation A) from the top wall 202 such that a bottom rim 212 of the outer wall 208 is seated on or above the impeller 206 of the agitation element 132. In some embodiments, the outer wall 208 forms a frustoconical shape. For instance, the outer wall 208 may taper outward from the top wall 202 to the bottom rim 212. In this regard, the bottom rim 212 may define a large circumference (e.g., when compared to the circumference of the top wall 202). The larger circumference of the bottom rim 212 may lessen the space between the wash basket 114 and the outer wall 208. Notably, the frustoconical shape of the outer wall 208 may constrain the footwear articles 201 within the footwear cleaning space 210. For example, footwear articles 201 may be positioned within the footwear cleaning space 210 (e.g., by a user) such that they are positioned at or below the bottom rim 212 outer wall 208. The bottom rim 212 may function as an upper boundary of the footwear cleaning space 210 that prevents or mitigates upward movement of the footwear articles 201 within the footwear cleaning space 210. Notably, the footwear cleaning basket 200 may constrain the footwear articles 201 such that they may be capable of moving circumferentially between the wash basket 114 and the footwear cleaning basket 200 but axial movement (e.g., movement along the axial direction A) of the footwear articles 201 within the wash basket 114 is inhibited or limited. In this regard, during operation of the washing machine appliance 100, unnecessary movement of the footwear articles 201 positioned within the footwear cleaning space of the wash basket 114 may be mitigated or reduced such that banging or impacts that may commonly occur during operation are avoided.

Additionally, the outer wall 208 may define a plurality of wash holes 214 therethrough. In some embodiments, the plurality of wash holes 214 are disposed around the outer wall 208 to allow wash fluids (e.g., water or wash additives) to pass through the footwear cleaning basket 200 during a wash cycle of the washing machine appliance 100. In this regard, during operation of the washing machine appliance 100, wash fluids may flow through the footwear cleaning basket 200 to sufficiently clean footwear articles 201 positioned within the footwear cleaning space 210.

Moreover, the footwear cleaning basket 200 may include one or more cleaning brushes extended into the footwear cleaning space 210. For instance, the footwear cleaning basket 200 may include a first cleaning brush 216 at the bottom rim 212 of the footwear cleaning basket 200. Particularly, the first cleaning brush 216 may extend downward from the bottom rim 212, and optionally, slightly outward (e.g., along the radial direction) from the bottom rim 212 into the footwear cleaning space 210. In some embodiments (e.g. FIGS. 4 and 5), the first cleaning brush 216 may include a plurality of brushes 218 (e.g., a plurality of dome brushes, a plurality of bristle brushes, etc.) spaced circumferentially apart around the bottom rim 212 of the footwear cleaning basket 200. The plurality of brushes 218 may each extend into the footwear cleaning space 210 such that footwear articles 201 positioned within the footwear cleaning space 210 may be physically agitated by the plurality of brushes 218 (e.g., to improve cleaning of the footwear articles 201). For example, as illustrated in FIG. 4, the plurality of brushes 218 may each comprise a dome shaped head with a plurality of bristles extended from the head. Each brush of the plurality of brushes 218 may extend downward and outward from the bottom rim 212 of the footwear cleaning basket 200.

In some other embodiments (e.g., FIG. 6), the cleaning brush includes an annular brush 220 attached to the bottom rim 212 of the footwear cleaning basket 200. In some such embodiments, the annular brush 220 may be positioned around the entire circumference of the outer wall 208. Particularly, the annular brush 220 may include a plurality of bristles or physical agitators that extend downward into the footwear cleaning space 210 such that footwear articles 201 positioned within the footwear cleaning space 210 may be physically agitated by the annular brush 220 (e.g., to improve cleaning of the footwear articles 201).

In some embodiments, the footwear cleaning basket 200 may further include a second cleaning brush 222 extended outward (e.g., along the radial direction) from the outer wall 208 of the footwear cleaning basket 200 into the footwear cleaning space 210. Particularly, the second cleaning brush 222 include a plurality of protruded agitators (e.g., brushes, bristles, foam pads, etc.) that may extend outward (e.g., along the radial direction) from the outer wall 208 into the footwear cleaning space 210. For example, as illustrated in FIG. 4, the second cleaning brush 222 includes a plurality of foam brushes that are each extended outward from the outer wall 208. In such embodiments, the second cleaning brush 222 is positioned above (e.g., along the axial direction) of the first cleaning brush 216. The plurality of protruded agitators of the second cleaning brush 222 may each extend into the footwear cleaning space 210 such that footwear articles 201 positioned within the footwear cleaning space 210 may be physically agitated by the second cleaning brush 222 (e.g., to improve cleaning of the footwear articles 201). Notably, this regard, the second cleaning brush 222 may further improve cleaning of footwear articles 201, such as when the footwear articles 201 may work upward within the footwear cleaning space 210 (e.g., during operation of the washing machine appliance 100).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a wash tub positioned within a cabinet, the wash tub defining an axial direction, a radial direction, and a circumferential direction;

a wash basket rotatably mounted within the wash tub and defining a wash chamber configured for receiving a load of clothes; and a footwear cleaning basket positioned within the wash basket, the footwear cleaning basket comprising:

a top wall and an outer wall extending downward from the top wall along the axial direction, the outer wall comprising a bottom rim at a bottom thereof, the footwear cleaning basket and the wash basket defining a main cleaning space and a footwear cleaning space therebetween, the main cleaning space being positioned above the footwear cleaning space; and a cleaning brush attached to the bottom rim of the footwear cleaning basket, the cleaning brush extending downward from the bottom rim along the axial direction into the footwear cleaning space.

2. The washing machine appliance of claim 1, wherein the cleaning brush comprises an annular brush attached to the bottom rim of the footwear cleaning basket.

3. The washing machine appliance of claim 1, wherein the cleaning brush comprises a plurality of brushes, and wherein the plurality of brushes are spaced circumferentially around the bottom ring.

4. The washing machine appliance of claim 1, wherein the outer wall defines a plurality of wash holes therethrough.

5. The washing machine appliance of claim 1, wherein the outer wall defines a frustoconical shape.

6. The washing machine appliance of claim 1, wherein the cleaning brush is a first cleaning brush attached to the bottom rim, wherein the footwear cleaning basket further comprises a second cleaning brush extended outward from the outer wall into the footwear cleaning space, and wherein the second cleaning brush is positioned above the first cleaning brush along the axial direction.

7. The washing machine appliance of claim 1, wherein the wash basket defines a vertical height, and wherein the footwear cleaning space is positioned below a bottom fifty percent of the vertical height of the wash basket.

8. The washing machine appliance of claim 1, wherein the washing machine appliance comprises:

an agitation element extended along the axial direction into the wash basket, and wherein the top wall of the footwear cleaning basket defines an agitation hole for slidably receiving the agitation element.

9. The washing machine appliance of claim 1, wherein the washing machine appliance further comprises:

an impeller disposed at a bottom wall of the wash basket, wherein the cleaning brush is seated on the impeller.

10. A footwear cleaning basket for a top-load washing machine appliance, the top-load washing machine appliance comprising a cabinet, a wash tub positioned within the cabinet, and a wash basket rotatably mounted within the wash tub and defining a wash chamber, the footwear cleaning basket comprising:

a top wall and an outer wall extending downward from the top wall along an axial direction, the outer wall comprising a bottom rim at a bottom thereof, the footwear cleaning basket and the wash basket defining a main cleaning space and an footwear cleaning space therebetween, the main cleaning space being positioned above the footwear cleaning space; and a cleaning brush attached to the bottom rim of the basket, the cleaning brush extending downward from the bottom rim along the axial direction into the footwear cleaning space.

11. The footwear cleaning basket of claim 10, wherein the cleaning brush comprises an annular brush attached to the bottom rim of the wash basket.

12. The footwear cleaning basket of claim 10, wherein the cleaning brush comprises a plurality of brushes, and wherein the plurality of brushes are spaced circumferentially around the bottom ring.

13. The footwear cleaning basket of claim 10, wherein the outer wall defines a plurality of wash holes therethrough.

14. The footwear cleaning basket of claim 10, wherein the outer wall defines a frustoconical shape.

15. The footwear cleaning basket of claim 10, wherein the cleaning brush is a first cleaning brush attached to the bottom rim, wherein the footwear cleaning basket further comprises a second cleaning brush extended outward from the outer wall into the footwear cleaning space, and wherein the second cleaning brush is positioned above the first cleaning brush along the axial direction.

16. The footwear cleaning basket of claim 10, wherein the wash basket defines a vertical height, and wherein the footwear cleaning space is positioned below a bottom fifty percent of the vertical height of the wash basket.

17. The footwear cleaning basket of claim 10, wherein the washing machine appliance comprises an agitation element extended along the axial direction into the wash basket, and wherein the top wall of the footwear cleaning basket defines an agitation hole for slidably receiving the agitation element.

18. The footwear cleaning basket of claim 10, wherein the washing machine appliance further comprises an impeller disposed at a bottom wall of the wash basket, and wherein the cleaning brush is seated on the impeller.

* * * * *